US007637857B2

(12) United States Patent
Coullery et al.

(10) Patent No.: US 7,637,857 B2
(45) Date of Patent: Dec. 29, 2009

(54) DEVICE FOR MAINTAINING SIDE TABS OF BOX BLANKS RUNNING THROUGH A FOLDER-GLUER

(75) Inventors: Gérard Coullery, Villars-le-Terroir (CH); Pascal Dumusc, Vionnaz (CH); Sacha Bourgeois, Bussigny-près-Laussane (CH)

(73) Assignee: Bobst, S.A. (CH)

( * ) Notice: Subject to any disclaimer, the term of this patent is extended or adjusted under 35 U.S.C. 154(b) by 0 days.

(21) Appl. No.: 11/331,679

(22) Filed: Jan. 13, 2006

(65) Prior Publication Data

US 2006/0178248 A1 Aug. 10, 2006

(30) Foreign Application Priority Data

Jan. 28, 2005 (EP) ..... 05405043

(51) Int. Cl.
*B31B 3/26* (2006.01)

(52) U.S. Cl. ..... 493/13; 493/70; 493/68; 493/183; 493/23

(58) Field of Classification Search ..... 493/183, 493/177, 245, 260–263, 478, 13, 23, 68, 493/70; 271/264
See application file for complete search history.

(56) References Cited

U.S. PATENT DOCUMENTS 1,937,027 A * 11/1933 Low ..... 493/167
2,774,286 A * 12/1956 La Bombard ..... 493/424
2,879,699 A * 3/1959 Labombarde ..... 493/408
2,883,916 A * 4/1959 Labombarde ..... 493/408
RE24,668 E * 7/1959 Rodman ..... 493/353
2,896,519 A * 7/1959 Goss ..... 493/167
2,899,872 A * 8/1959 Labombarde ..... 493/130
3,041,943 A * 7/1962 Turner ..... 493/76
3,045,561 A * 7/1962 Schempp ..... 493/111
3,055,276 A * 9/1962 Millich ..... 493/182
3,071,048 A * 1/1963 Levkoff ..... 493/176
3,237,535 A * 3/1966 Gross ..... 493/131
3,377,926 A * 4/1968 Propper ..... 493/10
3,529,515 A * 9/1970 Lang ..... 493/424
3,672,266 A * 6/1972 Klapp ..... 493/309
3,807,289 A * 4/1974 Labombarde ..... 493/408
3,901,134 A * 8/1975 Reizenstein et al. ..... 493/10
4,024,693 A * 5/1977 Leasure et al. ..... 53/564
4,044,658 A * 8/1977 Mitchard ..... 493/277
4,105,197 A * 8/1978 Pott ..... 493/416
4,432,745 A * 2/1984 Eldridge ..... 493/10
4,545,780 A * 10/1985 Martin ..... 493/11

(Continued)

FOREIGN PATENT DOCUMENTS

CH 457 114 A 5/1968

(Continued)

*Primary Examiner*—Rinaldi I. Rada
*Assistant Examiner*—Lindsay Low
(74) *Attorney, Agent, or Firm*—Ostrolenk Faber LLP

(57) ABSTRACT

A device for holding lateral tabs of box blanks filing along a conveyor particularly in a folder-gluer. At least one rotary support is actuated in synchronicity with the passage of said blanks the activation being via a drive member arranged on an adjustable bearing structure. At least one sensor detects the blanks. The sensor is connected to an electronic control unit that commands the drive member which is rendered autonomous.

5 Claims, 2 Drawing Sheets

U.S. PATENT DOCUMENTS 4,701,155 A * 10/1987 Ott ..... 493/14
4,715,846 A * 12/1987 Zak ..... 493/10
4,776,831 A * 10/1988 Morisod ..... 493/142
5,269,742 A * 12/1993 Crouch et al. ..... 493/177
5,980,440 A * 11/1999 Mitman et al. ..... 493/52
6,228,010 B1 * 5/2001 Toriyama ..... 493/23
2004/0033875 A1 * 2/2004 Jansen ..... 493/51
2005/0255979 A1 * 11/2005 Tisma et al. ..... 493/184

FOREIGN PATENT DOCUMENTS

EP 0 481 580 A 4/1992

* cited by examiner

DEVICE FOR MAINTAINING SIDE TABS OF BOX BLANKS RUNNING THROUGH A FOLDER-GLUER

BACKGROUND OF THE INVENTION

The subject of the present invention is a device for holding lateral tabs of box blanks passing through a folder-gluer, the machine commonly used in the packaging industry to make up boxes from cardboard blanks.

A folder-gluer machine generally comprises a series of modules, each intended to carry out a given operation so that the box blanks introduced at the input of the machine in a feeder, reemerge in the form of folded boxes ready for use. Typically, the operations carried out in a folder-gluer are in sequence: pre-breaking of certain fold lines of the blank, folding of parts such as the lateral tabs, folding of the front and rear tabs, coating the tabs with glue, pressing of the blanks once folded and glued, and their receipt at the end of the production line.

The box blanks are generally conveyed through the various modules of the machine via a belt conveyor which, through friction, holds the blanks either between lower and upper belts or between lower belts and upper press rollers.

It is in the module that folds the rear tabs that the device of the present invention finds its use. The folding of the rear tabs is a relatively complicated operation performed by one or more horizontal-axis rotary folders. These folders generally comprise two hooks mounted in opposition on a central hub which are able to move along a drive shaft positioned transversely to the direction of travel of the blanks. In a movement that is synchronized with the rate of travel of these blanks, these hooks each in turn emerge from the plane of passage of the blanks, in the space separating two consecutive blanks. Each hook is temporarily given a speed higher than the speed at which the blanks are moving, so that the hook is able, at a given moment, to catch the rear tab of the blank and fold it completely onto the rear part of the box blank.

To be able to carry out this folding operation, it is generally necessary to interrupt the belts or rollers of the upper conveyor which holds the lateral parts already folded, pressed against the lower conveyor. Without the action of the upper conveyor, these lateral tabs have the tendency to open up. This effect is more pronounced when the rear tab is being folded, during which operation, the rear of the blank is predisposed to being lifted by the rotary folder.

To prevent the lateral tabs from opening out or the lifting of the blank at the time of the folding of the rear tab, recourse to rotary supports is known. Such supports are described in patent CH 457 114 that describes a similar device. These supports consist of two diametrically opposed flexible fins or blades mounted in continuous rotation about a drive shaft so as to form a helix. The rotational speed of this shaft is directly dependent on the rate of travel of the blanks through the machine. To achieve this, the drive shaft is mechanically connected by a drive line either to the drive of the rotary hooks or to the main drive of the folder-gluer or alternatively to a so-called "synchronous" feeder so that it is always in perfect synchronicity with the rate at which the blanks pass through the machine.

A synchronous feeder is a mechanical entity that is able to synchronize the start of the blanks by means of feed guides mounted on toothed belts. This feeder is said to be "synchronous" because of its function that compensates for any delay on the part of the blank as a result of unwanted slippage against the conveyor.

The chief disadvantage with such a device for holding the lateral tabs lies in the fact that its operation is completely dependent on its drive system. This dependency prevents any time delay between the enaction of the rotary supports with respect to the folding of the rear tab by the rotary hook. Now, it has been found that, depending on the type of box being made up, the lateral tabs are not always positioned the same distance away from the rear tab. In such cases, the folded lateral parts of the blank are not always held in place at the most opportune moment.

According to another device known to those skilled in the art, the supports are not mounted on a spindle in continuous rotation but on the leaf of a hinge that allows the support to move back and forth. This support moves from one position to another by means of a return spring for example. The chief disadvantage with such a system lies in the fact that the mechanism is not rapid and reliable enough to sustain high production rates.

Another solution might be to provide a mechanical cam in the drive of the rotary supports, a mechanical cam allowing a predefined delay or advance to be introduced into the action of the rotary supports, depending on the boxes being processed. Such a solution would, however, suffer from a major disadvantage associated with the fact that it would then become necessary to provide as many specific cams as there are types of box to be processed. From an economic standpoint, such a solution is of course inconceivable.

SUMMARY OF THE INVENTION

The object of the present invention is to, at least in part, remedy the aforementioned disadvantages by providing an independent device that is both simple and inexpensive while at the same time offering working flexibility as much in its arrangement within the folder-gluer as in its operation that is improved through new possibilities.

To this end, the subject of the present invention is a device for holding the lateral tabs of box blanks filing along a conveyor particularly in a folder-gluer. At least one rotary support is actuated in synchronicity with the passage of the blanks the activation being via a drive member arranged on an adjustable bearing structure. At least one sensor detects the blanks. The sensor is connected to an electronic control unit that commands the drive member which is rendered autonomous.

Other features and advantages of the present invention will become apparent from the following description of the invention which refers to the accompanying drawings.

BRIEF DESCRIPTION OF THE DRAWINGS

The invention will be better understood from studying an embodiment taken by way of an entirely nonlimiting example and illustrated by the attached figures in which.

DESCRIPTION OF A PREFERRED EMBODIMENT

In order to avoid confusion in the following description, the terms front and rear are defined with reference to the direction indicated by an arrow D in which the blanks travel through the folder-gluer. Likewise, lateral and longitudinal also refer to the same arrow direction D, which also indicates the direction of the longitudinal axis of the machine.

Figure 1A:
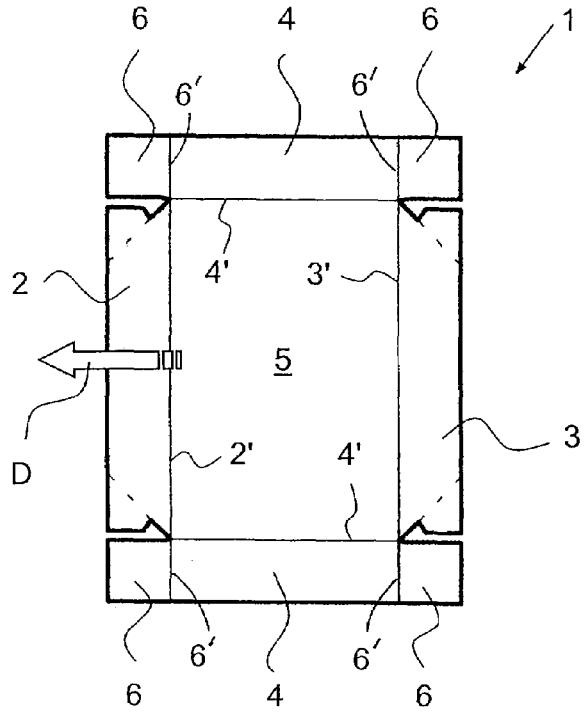
FIGS. 1*a* and 1*b* are schematic depictions of an example of an unfolded blank and of an example of the blank partially folded and glued, respectively.

FIG. 1*a* illustrates an example of a box blank 1 in developed unfolded form, in the state in which it enters the folder-gluer. This blank is formed of various parts including the front tab 2, the rear tab 3, and the lateral tabs 4 and 6. Also depicted are the main respective fold lines 2', 3', 4', 6' which delimit these tabs with respect to the bottom 5 of the blank 1.

Figure 1B:
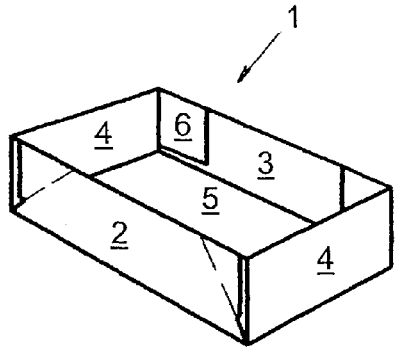

FIG. 1*b* illustrates the same blank 1 in a semi-folded form. As depicted, the blank 1 is able to yield a simple "double wall" box. However, it is to be understood that the choice of this particular type of box does not in any way limit the subject of the present invention.

Figure 2:
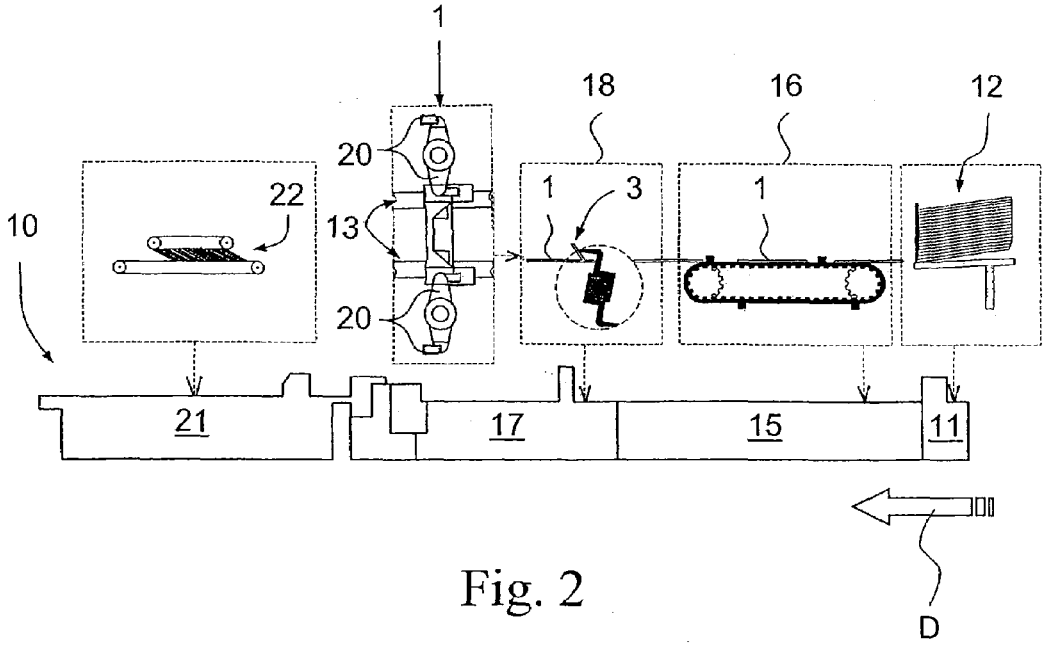
FIG. 2 is a schematic side view of a folder-gluer and of its modules, with a plan view of the device for holding the lateral tabs.

FIG. 2 provides a schematic side view of a folder-gluer 10 and of its modules, against which there is also shown a schematic plan view of certain operations performed on the blanks 1. The first module of the folder-gluer, illustrated as an example in this Figure, is the feeder 11 which feeds the machine one blank at a time from a pile 12. These blanks are conveyed in the folder-gluer from one module to the next by a conveyor 13 of the belt type for example.

The second module of the folder-gluer 10 is the breaker 15 the purpose of which is to fold the longitudinal tabs of the blanks 1 along the corresponding fold lines 4' and 6'. In order to synchronize the start of the blanks and space them apart uniformly on the conveyor 13, a synchronous feeder 16 is positioned at the input to the breaker 15. As it operates in the same or a similar way to the way described above, only its illustration is mentioned here. At the output from the module the device of the present invention is located.

It is in that third module that all the tabs that are to be folded are folded over along their fold lines. Included amongst these operations, mention may be made of the folding of the rear tab or tabs 3 which is performed by one or several rotary folders 18 as already described hereinabove.

During the folding of the rear tab 3, the blank 1 has to be held by its lateral tab 6 to prevent these from opening out, if they have already been folded, and/or to prevent the blank from lifting off the plane of the conveyor 13. To do this, the lateral tabs are held by means of the rotary supports 20, as depicted in the corresponding illustration viewed from above in FIG. 2. The rotary supports rotate generally at and just above the plane of the folded over lateral tabs 6.

The third module illustrated is the folder 17.

The last module illustrated in this Figure is a receiving module 21 in which the folded and glued boxes are positioned in a layer 22. Layering allows a high pressure to be applied more readily to the boxes in order to glue them, offers a longer drying time and, finally, makes it easier to collect the boxes as they leave the reception area.

Figure 3:
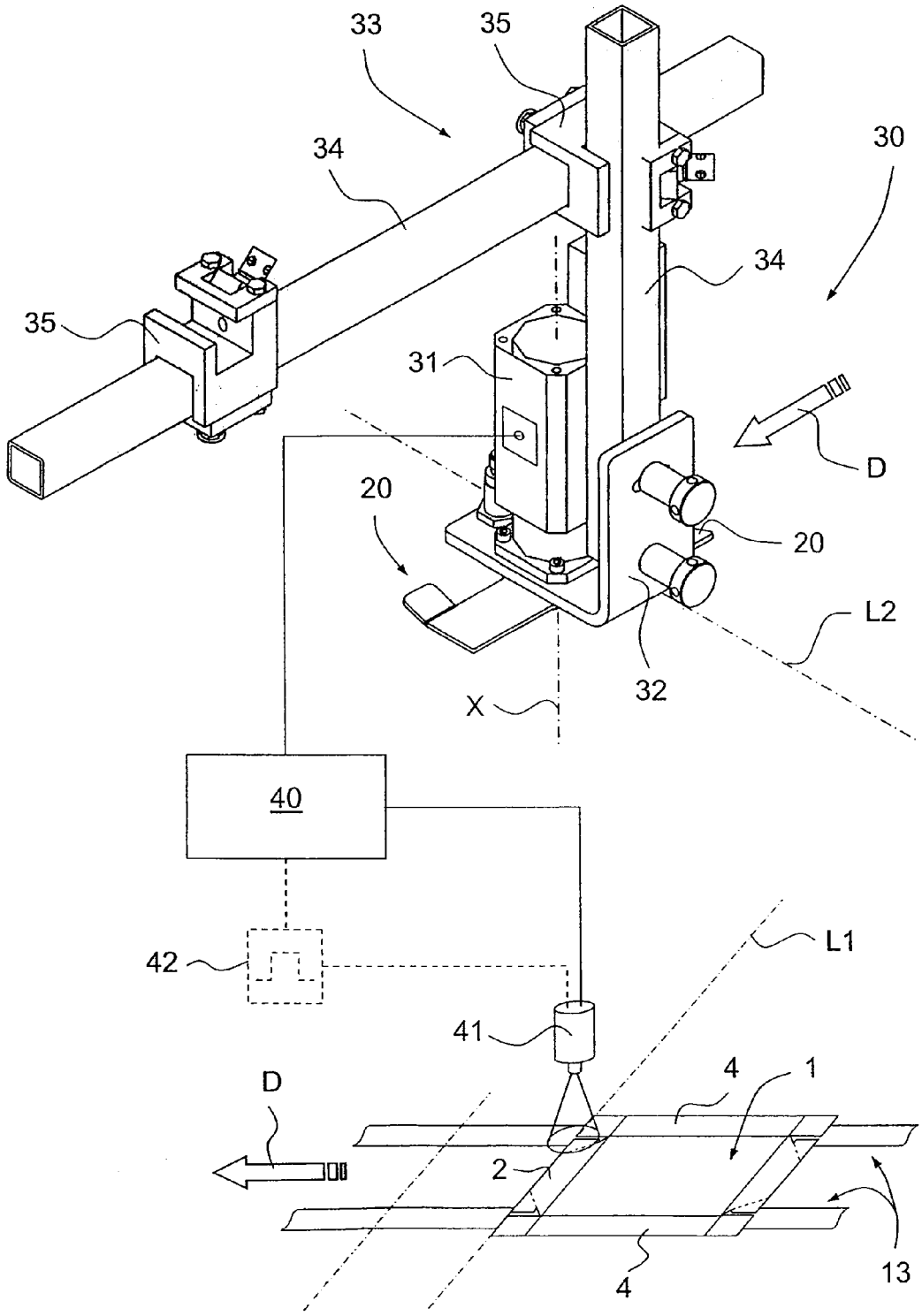
FIG. 3 is a schematic perspective view of the device of the present invention.

FIG. 3 is a schematic view of the device 30 of the present invention, illustrated in perspective. This device for holding the lateral tabs 6 comprises a drive member 31 for rotating at least one rotary support 20 at and generally above the plane of the folded over lateral tab. However, preferably, these rotary supports 20 are arranged directly at the end of the main shaft of the drive member 31. As shown, each rotary support comprises a piece which is rotated around the axis of the drive member 31 to rotate onto and then off the lateral tab. The drive member is fixed vertically or at an angle, via a support 32, to a bearing structure 33 that is adjustable in the lateral and longitudinal directions, and heightwise relative to the plane along which the blanks pass through the machine. In order to allow these adjustments, the bearing structure 33 comprises a plurality of posts 34 connected by yokes 35 that can be adjusted by sliding along these posts. By means of one of the yokes 35, the bearing structure 33 can easily be secured to the folder-gluer 10, for example by fixing it to the support structure thereof.

Because the device 30 is preferably intended to operate in synchronicity with at least one rotary folder 18 to fold over the rear tabs 3, the device 30 comprises an electronic control unit 40 connected to at least one detection sensor 41 for detecting the moving blanks 1. This electronic control unit commands the drive member 31 according to signals generated by the detection sensor 41. This sensor preferably comprises an optoelectronic cell detecting the moment when the front edge of the front tab 2 of a blank crosses an imaginary position line L1 determined by the position of the sensor 41 within the folder-gluer.

According to the speed at which this blank is moving and according to the known distance between the position line L1 and a second position line L2 passing through the vertical of the axis of rotation X of the drive member 31, the electronic control unit 40 is able to determine the time that it will take for the blank to cover this distance. Knowing also the shape and the dimensions of the blanks processed, and the number of rotary supports 20 and their instantaneous angular position, the electronic control unit is capable of commanding the rotation of the drive member 31 in such a way that one of the rotary supports rotates into the correct position for holding the lateral tab 6 of the blank when the rear tab 3 is being folded. In the same way, this same control unit will also ensure that the rotary supports are completely withdrawn from the lateral tabs before they collide with the rear tab or some other part of the blank 1. To do this, the geometric dimensions of the blanks processed will preferably be entered and stored in the form of parameters in the control unit during the setting-up of the folder-gluer.

The rate at which the blank moves can be determined by means of a sensor 41' (not shown) which is similar to the sensor 41, connected to the electronic control unit 40 and positioned upstream of the position line L1 at a given distance away. By calculating the time elapsed between the emissions of the signals for the two sensors 41 and 41', and knowing the distance between them, the control unit 40 can then determine the rate at which the blank 1 is moving.

By way of a variant, this rate of movement may also be determined using a special-purpose component, such as a pulse generator 42, connected to the drive of the conveyor 13 of the folder-gluer. Such a pulse generator is generally a component already present in most folder-gluers. It is able to generate pulses at a frequency dependent on the speed of the conveyor 13. When used in conjunction with the sensor 41, these two components allow the control unit 40 to determine the rate of travel of the blank, to discover the moment at which it crosses the position line L1, and to generate control signals for commanding the drive member 31. This variant is illustrated in broken line in FIG. 3.

Preferably, the electronic control unit 40 will simultaneously command two drive members 31, one positioned on each side of the passage of the blanks so that each of these devices can act on the lateral tabs 6 of the blanks. Also, the device 30 is not necessarily intended to be used in conjunction with one or more rotary folders 18 but could also be used in any situation where it is necessary or would be opportune to hold the lateral tabs.

The drive member 31 preferably comprises a servo-motor or an equivalent motor, allowing fine, precise and rapid rotation of its rotation shaft and therefore of the rotary supports 20. By virtue of such a motor and of such an electronic control unit, the drive member 31 is advantageously rendered autonomous with respect to the various drives that exist within the machine. This independence allows the device 30 to be positioned anywhere in the folder-gluer without facing any problem of drive or of synchronicity of the rotary supports. In addition, when blanks have lateral tabs 6 distant from the rear tab 3 by a non-uniform length, the device 30 in this case can easily be moved and adjusted to suit the position of these tabs on the blank.

Advantageously also, this device offers the possibility of controlling the rotation of the rotary supports over time, thus gaining control over their synchronicity without a mechanical link, either with one of the drive members of the folder-gluer or with the rotary folder 18.

This device 30 also affords a solution to folder-gluers equipped with new-generation rotary folders with which it is no longer possible to couple an auxiliary device.

The device of the present invention makes it also possible to vary the action time of the rotary supports on the lateral tabs. Thus, the electronic control unit 40 may, for example, deliberately slow the angular velocity of the shaft of the drive device 31 so that the lateral tabs are held for as long as possible by the rotary supports as the blank passes through the device 30. The curve representing the holding time of the lateral tabs during a cycle can thus be varied and readily adapted in order to obtain optimum action. This flexibility stems from the components that make up the device 30 and which lead to the embodiment of an "electronic cam" by reference to the mechanical cams which do not, however, themselves offer any of these additional options.

Advantageously, by virtue of the electronic cam of the device of the present invention, the latter no longer requires the use of a synchronous feeder unlike the devices of the prior art. Thus, any possible offset in the longitudinal position of the blank as it is introduced onto the conveyor no longer presents any problem in the holding of the lateral tabs by rotary supports further downstream. Any possible longitudinal slippage of the blank as it is being conveyed upstream of the folder no longer presents any problem.

Advantageously also, the device 30 makes it possible to obtain higher production rates than could be obtained with the devices of the prior art. In addition, by comparison with the latter, it will be noted that the rotary supports of the device of the present invention are driven in synchronicity by an appreciably simplified mechanism. Also, the independence resulting from this device makes it easier to install on the machine, and to remove or to change its location, and makes it possible to reduce the time needed to set up the folder-gluer while at the same time contributing to reducing production costs, particularly for small manufacturing runs.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for holding lateral tabs of a plurality of box blanks filing in a conveyer plane along a conveyor, each blank including a first lateral tab, a second lateral tab and a rear tab, the device comprising:

a first rotary support for holding a blank of the plurality of blanks reaching a first location along the conveyor, the first rotary support operable to hold the first lateral tab of the blank for a pre-set period of time without folding the blank, while a folding operation is performed on the rear tab of the blank by another device, the first rotary support positioned to be rotated about an axis transverse to the conveyer plane at the conveyor for the pre-set period of time in synchronicity with passage of the blank at the first location along the conveyor;

a first drive member fixed vertically to a bearing structure and connected for rotating the first rotary support to the first lateral tab of the blank at the conveyor for the pre-set period of time;

a sensor positioned and operable to detect the blank reaching a sensed location along the conveyor;

an electronic control unit connected with the sensor and operable for commanding operation of the first drive member to rotate the first rotary support, the electronic control unit operable to control rotation by the first drive member based on the detection by the sensor of the blank at the sensed location, an additional rotary support positioned to be rotated to hold for the pre-set period of time the second lateral tab of the blank at the conveyor in synchronicity with the passage of the blank at the first location along the conveyor; and an additional drive member connected for operating the additional rotary support, the additional drive member positioned on the bearing structure and operable, independently of the first rotary support and the first drive member, to be commanded by the electronic control unit for rotating the additional rotary support based on the detection by the sensor of the blank at the sensed location along the conveyor.

2. The device according to claim 1, wherein the first drive member comprises a servomotor.

3. The device according to claim 1, further comprising a pulse generator connected to the sensor and the electronic control unit, the pulse generator operative to produce pulses dependent on the speed of the conveyor for controlling the pre-set period of time for holding the blank by the first rotary support.

4. The device according to claim 1, wherein the sensor comprises an optoelectronic cell.

5. The device of claim 1, wherein the first rotary support has a distal end and comprises a piece at the distal end of the first rotary support that rotates onto a lateral tab of the blank to hold the blank and then rotates off the lateral tab to release the blank, the lateral tab located on a side of the blank perpendicular to the direction of travel of the blank along the conveyor, wherein the electronic control unit is operable according to signaling received from the sensor to rotate the piece onto and then outward and away from a center of the blank off the lateral tab.

* * * * *